US006183161B1

(12) United States Patent
Neeper

(10) Patent No.: US 6,183,161 B1
(45) **Date of Patent: *Feb. 6, 2001**

(54) LIGHTWEIGHT PORTABLE UNIT FOR PAINT STRIPING OF PAVEMENT

(76) Inventor: Jeffrey W. Neeper, 1027 Metcalf Rd., Toledo, OH (US) 43615

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/262,522

(22) Filed: Mar. 4, 1999

Related U.S. Application Data

(60) Provisional application No. 60/076,930, filed on Mar. 5, 1998.

(51) Int. Cl.[7] ..... B05B 1/24; E01C 23/16

(52) U.S. Cl. ..... 404/94; 404/93; 239/129; 239/130; 165/163

(58) Field of Search ..... 404/93, 94; 239/128, 239/129, 131, 130; 237/12.3 C, 12.3 R; 165/43, 48.1, 60, 145, 163

(56) References Cited

U.S. PATENT DOCUMENTS 2,727,786 * 12/1955 Bede .
2,980,339 * 4/1961 Bok et al. .
3,092,325 * 6/1963 Brown, Jr. et al. .
3,902,666 * 9/1975 Ito et al. ..... 239/130
4,190,205 * 2/1980 Mitchell ..... 239/129
4,196,854 * 4/1980 Prucyk ..... 239/129
4,363,355 * 12/1982 Prucyk ..... 165/81
4,462,547 * 7/1984 Metz ..... 239/130
4,576,122 * 3/1986 Marcato ..... 122/26
4,593,753 * 6/1986 McConnell ..... 165/51
4,624,602 * 11/1986 Kieffer et al. ..... 404/94
4,893,751 * 1/1990 Armstrong ..... 239/150
5,785,760 * 7/1998 Sconyers et al. ..... 148/600
5,983,990 * 11/1999 Alvarez ..... 165/48.1

* cited by examiner

*Primary Examiner*—Eileen D. Lillis
*Assistant Examiner*—Gary S. Hartmann
(74) *Attorney, Agent, or Firm*—Charles F. Schroeder

(57) ABSTRACT

A lightweight manually maneuverable, quick-drying paint striper for painting stripes on pavements, in which the hot exhaust gas of an internal combustion engine driving a paint pressurizing unit for the system is used to heat the paint by passing it through a heat exchanger to establish a temperature and viscosity appropriate for painting stripes with an air nozzle or airless nozzle. When an air nozzle is used, the air is heated by the exhaust gas in the same or another heat exchanger in a manner similar to that in which the paint is heated in the exchanger.

15 Claims, 3 Drawing Sheets

LIGHTWEIGHT PORTABLE UNIT FOR PAINT STRIPING OF PAVEMENT

This application claims the benefit of U.S. Provisional Application 60/076,930 filed Mar. 5, 1998.

BACKGROUND OF THE INVENTION

The invention is a portable manually maneuverable painting unit or machine for painting stripes on pavements such as roads, streets and parking lots. The paint in such operation is preferably heated particularly because of viscosity problems in painting during cold weather. During cold weather the viscosity of the paint becomes abnormally high, making it in most instances difficult or impossible to paint the stripes desired. By heating the paint, striping can be accomplished during weather conditions which otherwise would prohibit striping operations.

Whereas larger units, such as truck units, utilize hot water heating units for heating the paint, such hot water heating units are of such bulky size and weight as to make incorporation in portable units impractical. Propane heating units have been known to be used for such purposes but such heating units are also too large to classified as portable manually operable units as proposed.

BRIEF SUMMARY OF THE INVENTION

According to the present invention, by use of the hot exhaust gas from an internal combustion engine driving a pressure producing unit, such as a compressor or paint pump in the system, the paint is heated to a lower viscosity appropriate for painting stripes on pavements. Because of the heat, lowered viscosity, the amount of solvent or thinning agent necessary to provide the low viscosity can be reduced to a minimum, which in turn reduces the drying time as well as possible danger of toxicity from solvents. Additionally, the hot paint in hitting a usually lower temperature pavement is cooled quickly further reducing the drying time and adding to the durability of the applied stripes.

When air is used to assist spraying the paint at the nozzle, the exhaust gas from the engine can be used to heat both the paint and the air used to spray the paint. Whereas in airless spray systems, the paint alone is all that requires heating.

In the use of the term "paint" for striping, it is contemplated that the term apply as well to other materials such as thermoplastic resins in fluid form also capable of being applied as stripes with the apparatus of the present invention.

The exhaust gas from an engine such as from even the smallest Honda engine, in driving the compressor or pump of striping unit, has been found to perform excellently in heating paint directly in a heat exchanger. The heat exchanger can be in the form of a simple cylindrical container through which tubing conveys the paint where it receives heat of the gas of the engine exhaust to heat the paint. The tubing conveying the paint is usually made of metal such as copper, steel or an alloy metal, and may be shaped, for example, in the form of a coil or in U-shape or merely passed straight through the exchanger. When the striping is done with an air gun, to assure that the paint is not cooled before it strikes the pavement, the air can be passed through the same heat exchanger as that used to heat the paint, or possibly another heat exchanger. In this regard, heating the air assists in retention of the flowability of the paint for the striping operation. If the air is heated in a separate heat exchanger, a muffler type exchanger can be provided which also receives its heat from the exhaust of the compressor engine.

An object of the invention is to provide a small portable striping unit readily and efficiently operable manually independent of temperature conditions.

Another closely related object is to provide a lightweight road and parking lot striping machine manually maneuverable by a single person.

A feature of the invention is that by heating the paint, the amount of solvent necessary to maintain the desired fluidity can be reduced, which in turn results in quicker drying of the paint with greater durability.

Another feature is that by use of the hot exhaust of an engine to heat the paint and the air at the striping gun or nozzle, the seasons of the year can be reduced as a variable in determining when striping operations are to be conducted.

A further feature of the invention is the ecological advantage which it provides by use of a lesser amount of solvent necessary to maintain the desired paint fluidity.

DETAILED DESCRIPTION

Figure 1:
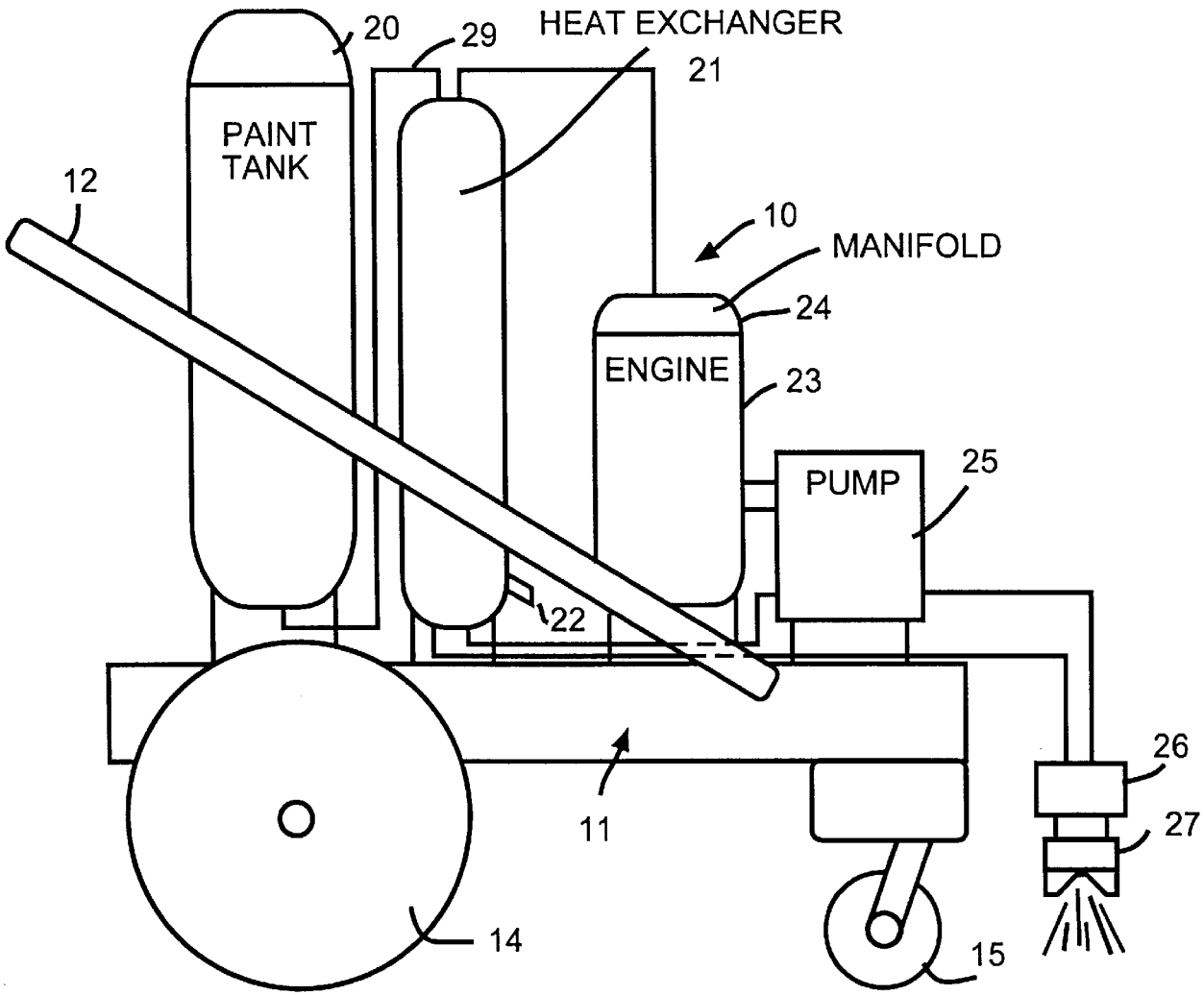
FIG. 1 is a schematic representation of a lightweight portable, manually maneuverable, striping unit of the present invention.

Turning to the drawings in greater detail, FIG. 1 illustrates schematically the general arrangement of components on a manually maneuverable lightweight striper of the invention. The assembly is mounted on a carriage 11 having rear wheels 14 and a front wheels 15 and a carriage handle 12 to allow manual movement by linear and turning action. A paint tank 20 is mounted over the larger rear wheels 14. The paint from the tank 20 is fed through a connecting tube 29 to a heat exchanger 21. It passes through a heat receiving passage of the heat exchanger 21 to a paint pump 25 which in turn supplies the striping paint to the paint gun 26 and its striping nozzle 27 from which the striping fluid is deposited onto a pavement. The paint pump 25 is driven by an internal combustion engine 23 which emits hot exhaust gases to an exhaust chamber 24. To maintain the fluidity of the paint as it passes through the system and is emitted by the paint gun 26, the hot exhaust gas of the engine 23 is introduced to the heat exchanger 21 in enveloping relationship about the tube through which the paint if fed. The paint is thus heated in the heat exchanger and fed to the pump 25 for release from the striping nozzle 27.

Figure 2:
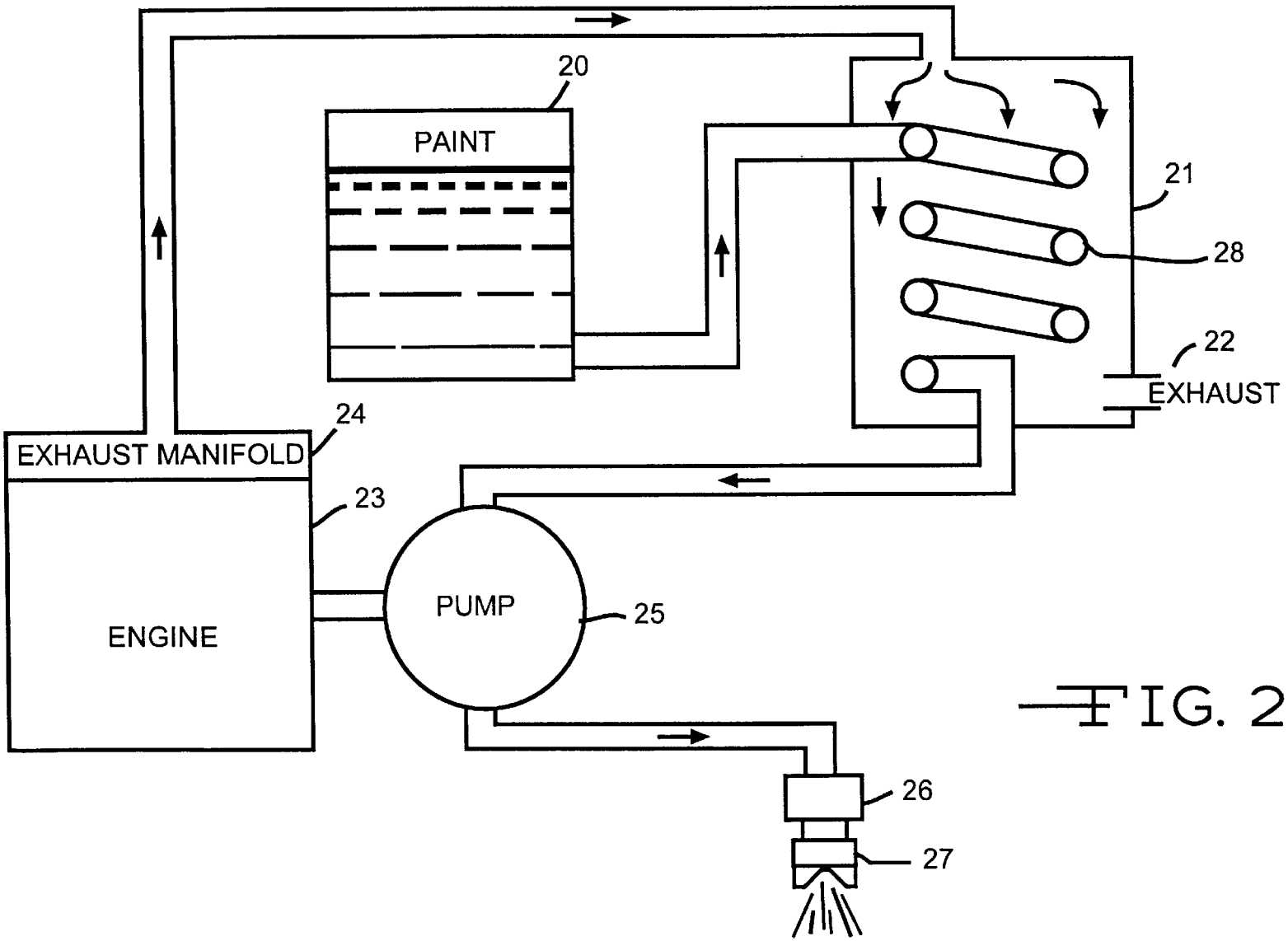
FIG. 2 is a block diagram showing how components of the present invention are interconnected to utilize the hot exhaust gases of an internal combustion engine driving the pump an airless striping gun.

FIG. 2 illustrates in block diagram form how the striper components are connected to effect supply of heated paint for emission from the paint gun 26. The paint is drawn from the paint tank or reservoir 20 and through a tube in the form of a coil 28 in the heat exchanger 21 by the negative pressure action of the paint pump 25 which supplies hot paint to the paint gun 26. Power for driving the pump 25 comes from the engine 23 which is connected thereto. Hot gases of the engine 23 are supplied from the manifold 24 of the engine to the heat exchanger. The hot gases fill the heat exchanger and effect the heating of the coil 28 and the paint passing therethrough. The spent gases of the heat exchanger are released from an outlet to 22.

Figure 3:
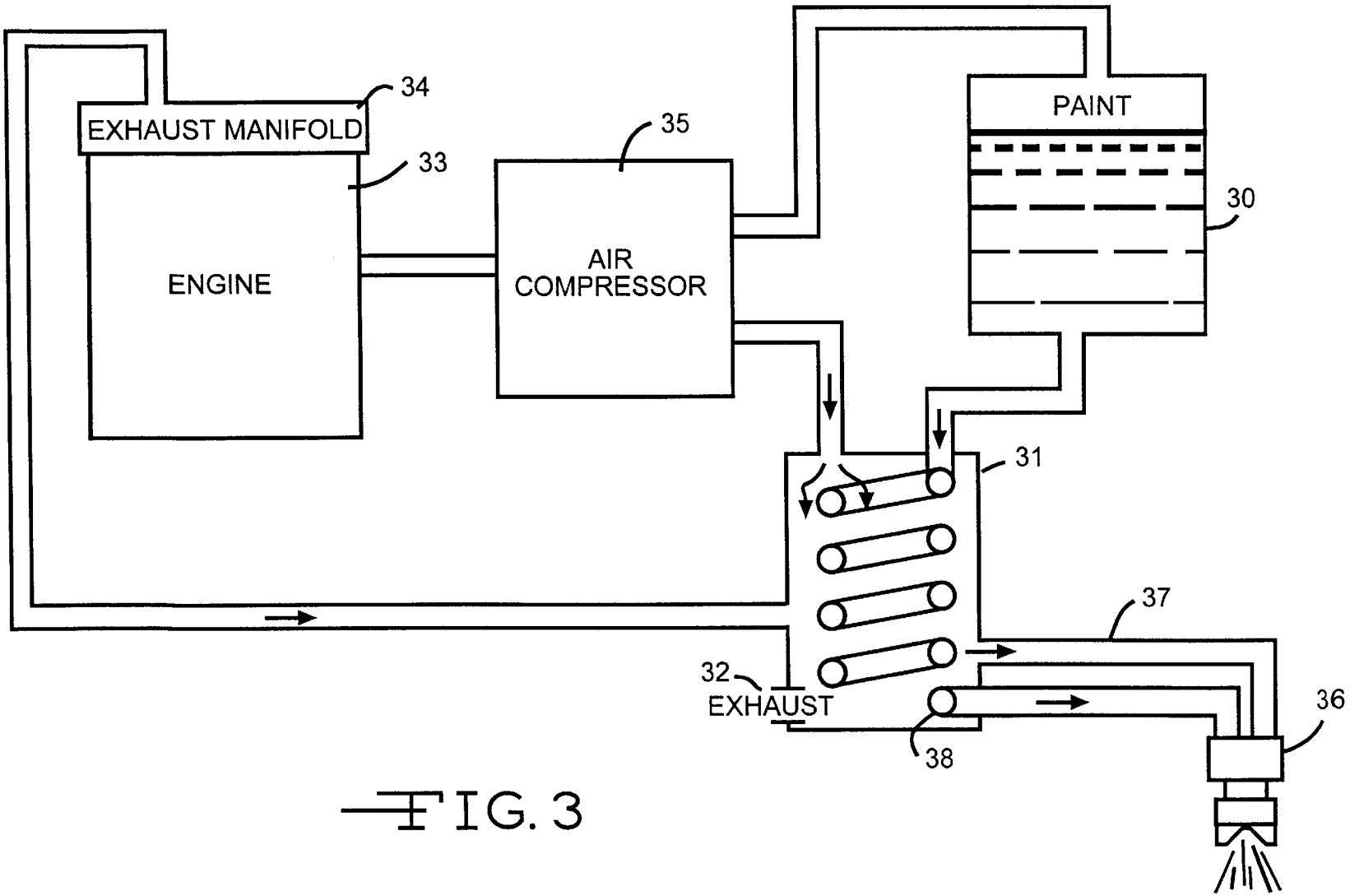
FIG. 3 is a block diagram showing how components of the invention are connected to provide both hot air and heated striping fluid together as the striping fluid is deposited from a nozzle.

FIG. 3 illustrates in similar schematic form an arrangement for supply of paint to an air assisted nozzle 37 where the hot paint as well as air are correspondingly heated by engine exhaust gases. Hot exhaust gas from engine 33 is supplied from its muffler 34 to a heat exchanger 31 which fills the exchanger. The exchanger is provided with an outlet 32 for release of spent gas. The engine 33 drives an air compressor 35 which supplies air pressure to the paint in the tank 30. The paint flows through a coiled tubing 38 which provides a passageway for the paint through the heat of the exchanger 31. The air compressor 35 also supplies air in a separate path 37 through the heat exchanger for release as hot air under pressure at the paint gun 36 to further establish the fluidity of the paint as it is released from the nozzle 36.

In view of the foregoing, it will be understood that many variations of the invention can be provided within the broad scope of principles embodied herein. Thus, while particular preferred embodiments of the invention have been shown and described, it is intended by the appended claims to cover all such modifications which fall within the true spirit and scope of the invention.

What is claimed is:

1. A portable manually maneuverable paint striper for striping pavements comprising;

a carriage on which the components of said striper are mounted, said carriage having a handle for maneuvering said striper for placement of a stripe on a pavement, a striping nozzle for application of paint stripes to a pavement over which said striper is maneuvered, said components comprising a paint reservoir for paint supplied to said nozzle, a pressure unit for pressurizing paint supplied to said nozzle, an internal combustion engine mechanically connected to drive said pressure unit, a heat exchanger connected to receive hot exhaust gas of said engine and including a heat receptive passage within said heat exchanger for supply of paint therethrough heated by said hot exhaust gas, said passage in heated condition as heated by said hot gas being effective to provide the heat required for striping the paint supplied therethrough to said nozzle, said passage being connected directly to said nozzle for striping the paint passed therethrough.

2. A paint striper as set forth in claim 1 in which said nozzle is an airless nozzle, and said pressure unit is a pump for supply of paint to said nozzle.

3. A paint striper as set forth in claim 2 in which said pump is connected to draw paint from said reservoir through said heat exchanger.

4. A paint striper as set forth in claim 1 in which said pressure unit is an air compressor, and means is included for supply of air from said compressor to said striping nozzle to aid in distribution of the paint from said nozzle as a strip.

5. A striper as set forth in claim 4 including connection means for passing the air supplied to said nozzle through said heat exchanger to heat the air supplied to said striping nozzle along with the heated paint emitted therefrom.

6. A portable manually maneuverable paint striper for striping pavements comprising a reservoir of paint for said striper, a stripe producing nozzle, a pressure unit for application of pressure to said reservoir to effect supply of paint from said reservoir to said nozzle, an internal combustion engine for driving said pressure unit, a heat exchanger including a passage therethrough through which the paint supplied to said nozzle is passed, and means for supply of exhaust gas of said engine to said heat exchanger to heat the paint passed therethrough.

7. A paint striper as set forth in claim 6 in which said pressure unit is a pump, and said nozzle is an airless nozzle supplied with paint from said pump.

8. A striper as set forth in claim 7 in which said pump is connected to draw paint from said reservoir through said heat exchanger.

9. A paint striper as set forth in claim 6 including means for a supply of air to said striping nozzle to aid in distribution of the paint emitted from said nozzle as a stripe.

10. A striper as set forth in claim 9 including means for passing the air supplied to said nozzle through said heat exchanger to effectively heat the air supplied to said striping nozzle along with the heated paint emitted therefrom.

11. A paint striper as set forth in claim 9 in which said means for supply of air to said nozzle is an air compressor.

12. A paint striper as set forth in claim 11 in which said paint reservoir is connected for receipt of air pressure from said compressor.

13. A method of providing a lightweight manually maneuverable paint striping system for striping pavement by reducing the number of components required comprising;

feeding paint from a source in a paint supply system to a striping nozzle, supplying of flow pressure from a pressurizing unit to the paint in said system, supplying driving power to said pressure unit from an internal combustion engine, supplying the hot exhaust gas of said engine to a heat exchanger, passing the paint in said system through a heat recptive passage in said heat exchanger to effect heating of said paint with said exhaust gas and thereupon directly feeding the hot paint to said nozzle for striping said paint, thereby substantially eliminating the need for a separate component for heating of paint fed to said nozzle.

14. A method of providing a paint striping system as set forth in claim 13 in which a positive pressure is applied to the paint in the system flowing from the paint source to the nozzle.

15. A method of providing a paint striping system as set forth in claim 13 in which paint is drawn from the source of paint and through the heat exchanger by negative pressure supplied by pump means feeding said nozzle.

* * * * *